US009556679B2

(12) United States Patent
Larronde et al.

(10) Patent No.: US 9,556,679 B2
(45) Date of Patent: Jan. 31, 2017

(54) ROTARY STEERABLE ASSEMBLY INHIBITING COUNTERCLOCKWISE WHIRL DURING DIRECTIONAL DRILLING

(75) Inventors: Michael L. Larronde, Houston, TX (US); Elaine Larronde, Houston, TX (US); Daryl Stroud, Gloucester (GB); Jeff Johnson, Magnolia, TX (US); Mike Spencer, Conroe, TX (US)

(73) Assignee: Precision Energy Services, Inc., Houston, TX (US)

( * ) Notice: Subject to any disclaimer, the term of this patent is extended or adjusted under 35 U.S.C. 154(b) by 416 days.

(21) Appl. No.: 13/213,354

(22) Filed: Aug. 19, 2011
(Under 37 CFR 1.47)

(65) Prior Publication Data

US 2013/0043076 A1 Feb. 21, 2013

(51) Int. Cl.
*E21B 7/06* (2006.01)

(52) U.S. Cl.
CPC ..... *E21B 7/067* (2013.01); *E21B 7/062* (2013.01)

(58) Field of Classification Search
CPC ..... E21B 7/06; E21B 4/02; E21B 4/18; E21B 4/20; E21B 17/10
USPC ..... 175/61, 428, 73, 56, 267, 408, 26, 74, 75,175/76, 325.3, 256; 166/250.01, 330, 381; 702/9
See application file for complete search history.

(56) References Cited

U.S. PATENT DOCUMENTS 3,563,323 A 2/1971 Edgecombe
4,394,881 A 7/1983 Shirley
4,982,802 A 1/1991 Warren et al.
5,042,597 A 8/1991 Rehm et al.
5,113,953 A 5/1992 Noble
5,213,168 A 5/1993 Warren et al.
5,941,323 A 8/1999 Warren
6,092,610 A 7/2000 Kosmala et al.
6,109,372 A 8/2000 Dorel et al.
(Continued)

FOREIGN PATENT DOCUMENTS

GB 1494273 12/1977
WO 00/57018 9/2000
WO 01/09478 2/2001

OTHER PUBLICATIONS

International Search Report received in corresponding patent application No. PCT/US2010/051285, mailed Oct. 22, 2012.
(Continued)

*Primary Examiner* — Robert E Fuller
*Assistant Examiner* — Steven MacDonald
(74) *Attorney, Agent, or Firm* — Blank Rome LLP

(57) ABSTRACT

A bottom hole assembly avoids damaging vibrations that can develop during directional drilling with a rotary steerable system. The assembly has a drill bit, a first collar that rotates with the bit, a rotary steerable tool that controls the bit's trajectory, and a second collar that rotates with the drill string. The first collar between the bit and the tool defines a bend that deflects the bit from the first collar's axis. During operation, this bend causes portion of the assembly to engage the borehole wall to inhibit counterclockwise (CCW) bit whirl by promoting clockwise whirl in the assembly, generating friction against the borehole wall, and dampening vibrations. By inhibiting CCW bit whirl, other damaging vibrations such as CCW whirl in the drill string can also be prevented up the borehole. Alternatively, only the second collar between the tool and the drill string may define the bend, or both collars can define bends.

35 Claims, 4 Drawing Sheets

(56) References Cited

U.S. PATENT DOCUMENTS

| | | | | |
|---|---|---|---|---|
| 6,116,354 | A | 9/2000 | Buytaert | |
| 6,158,529 | A | 12/2000 | Dorel | |
| 6,206,108 | B1 * | 3/2001 | MacDonald | E21B 44/00 175/24 |
| 6,244,361 | B1 | 6/2001 | Comeau et al. | |
| 6,269,892 | B1 * | 8/2001 | Boulton et al. | 175/61 |
| 6,364,034 | B1 | 4/2002 | Schoeffler | |
| 6,394,193 | B1 | 5/2002 | Askew | |
| 6,571,888 | B2 | 6/2003 | Comeau et al. | |
| 6,595,303 | B2 | 7/2003 | Noe et al. | |
| 6,708,769 | B2 | 3/2004 | Haugen et al. | |
| 6,837,315 | B2 | 1/2005 | Pisoni et al. | |
| 6,840,336 | B2 | 1/2005 | Schaaf et al. | |
| 6,892,830 | B2 | 5/2005 | Noe et al. | |
| 7,188,685 | B2 | 3/2007 | Downton et al. | |
| 7,267,184 | B2 | 9/2007 | Helms et al. | |
| 7,306,056 | B2 * | 12/2007 | Ballantyne et al. | 175/61 |
| 8,550,183 | B2 * | 10/2013 | Forster et al. | 175/57 |
| 2001/0052428 | A1 * | 12/2001 | Larronde | E21B 7/062 175/61 |
| 2002/0011359 | A1 | 1/2002 | Webb et al. | |
| 2003/0121702 | A1 | 7/2003 | Downton et al. | |
| 2003/0127252 | A1 | 7/2003 | Downton et al. | |
| 2005/0056463 | A1 * | 3/2005 | Aronstam | E21B 7/062 175/61 |
| 2005/0150692 | A1 * | 7/2005 | Ballantyne | E21B 7/062 175/61 |
| 2006/0065395 | A1 * | 3/2006 | Snell | 166/255.2 |
| 2006/0243487 | A1 | 11/2006 | Turner et al. | |
| 2007/0163810 | A1 * | 7/2007 | Underwood et al. | 175/61 |
| 2008/0041629 | A1 | 2/2008 | Aronstam et al. | |
| 2008/0142268 | A1 * | 6/2008 | Downton | E21B 7/067 175/61 |
| 2008/0149394 | A1 | 6/2008 | Downton | |
| 2009/0057018 | A1 | 3/2009 | Farley | |
| 2011/0214919 | A1 * | 9/2011 | McClung, III | 175/57 |

OTHER PUBLICATIONS

"Borehole Quality Analysis COmparing Rotary Steerable Tools to Conventional Directional Drilling Asemblies." Mike Moody, Paul Boonen—PathFinder Energy Services; AADE-05-NTCE-44, Apr. 2005, 8 pages.

"Real-Time Stick-Slip and Vibrationg Detection for 8½"-Hole-Size Rotary Steerable Tools in Deeper Wells and More Aggresive Drilling," Junichi Sugiura, Steve Jones—PathFinder Energy Services, AADE-07-NTCE-47, Apr. 2007, 10 pages.

"Downhole Tools: Rotary steerable systems prove value offshore Indonesia, offshore Libya, in Gulf of Mexico," by Simon Peach, Weatherford International, Mar./Apr. 2007, 4 pages.

"Rotary Steerable advances push reliability, applications, performance up another level," Drilling Contractor, Mar./Apr. 2008, 6 pages.

"Concurrent Rotary Steerable and Underreamer Technology Provides Operators with a Cost-Effective Alternative for Directional Drilling and Hole Enlargement Onshore and Offshore Egypt," Steve Jones, Junichi Sugiura and Ibrahim Azmi—PathFinder Energy Services; Copyright 2007, IADC World Drilling 2007 Jun. 14, 2007, 10 pages.

Automated Steering and Real-Time Drilling Process Monitoring Optimizes Rotary-Steerable Underreamer Technology Junichi Sugiura and Steve Jones—PathFinder Energy Services; Copyright 2008, IADC World Drilling, Jun. 12, 2008, 10 pages.

Schlumberger, "Rotary steerable system for supercharged drilling: PowerDrive vorteX," obtained from www.slb.com/powerdrive ; Copyright 2008, 6 pages.

Schlumberger, "PowerDrive X5: Rotary steerable systems for performance drilling," obtained from www.slb.com/powerdrive, Copyright 2007, 6 pages.

Schlumberger, "PowerDriveXceed: Designed for productive drilling that gets wells to the best place in less time."

Schlumberger, "PowerV: Automatic vertical drilling optimization," obtained from www.slb.com/oilfield, Mar. 2005, 5 pages.

"Well-Guide RSS: Rotary Steerable System 10-300 Series," GyroData Services Catalog, 2007, 4 pages.

"Well-Guide RSS: Rotary Steerable System," GyroData Drilling Automation, undated, 1 page.

Weatherford, "Directional Drilling: Revolution Rotary-Steerable Service 6¾ in. System," obtained from weatherford.com (c) 2006-2008, 2963.05, 2 pages.

Weatherford, "Directional Drilling: Revolution Rotary-Steerable Service 8¼ in. System," obtained from weatherford.com (c) 2006-2008, 2957.05, 2 pages.

Weatherford, "Directional Drilling: Revolution Rotary-Steerable Service 4¾ in. System," obtained from weatherford.com (c) 2006-2008, 2960.05, 2 pages.

"Adding New Dimensions in Service," Weatherford Magazine Feb. 2006 vol. 8 No. 1; 28 pages.

"Revolution Rotary-Steerable Systems," Weatherford Brochure 3608.01, (c) 2007, obtained from www.weatherford.com, 8 pages.

Weatherford,"Real Results: Revolution Service Improves Drilling Efficiency and Reduces Differential Sticking in Highly Deviated Wellbore," obtained from www.weatherford.com (c) 2008, 5031.00 , 1 page.

Weatherford, "Real Results: First Successful Underbalanced Operation in Horizontal Section Uses Rotary Steerable and EMpulse Technology," obtained from www. weatherford.com, (c) 2008, 4957.00, 1 page.

Weatherford, "Real Results: Revolution Rotary-Steerable Service Sets New High-Temperature Record in the North Sea," obtained from www. weatherford.com, (c) 2008, 6019.00, 1 page.

Weatherford, "Real Results: Successful Introduction of 12¼ in. Revolution Rotary-Steerable Service in the Southern North Sea Establishes Drilling Benchmark," obtained form www. weatherford.com, (c) 2008, 5033.00, 1 page.

Weatherford, "Drilling SErvices: At-Bit Measurement System-4¾ in." obtained from www. weatherford.com, (c) 2008, 5555.00, 2 pages.

Weatherford, "Directional Drilling: Weatherford HyperLine Plus Drilling Motor," obtained from www.weatherford.com, (c) 2008, 6304.00, 2 pages.

Office Action for corresponding CA Patent Application No. 2,845,097; dated Feb. 5, 2016; pp. 1-4.

Supplementary Search Report and Written Opinion for corresponding EP Appl. 12825750, dated Apr. 11, 2016.

* cited by examiner

ROTARY STEERABLE ASSEMBLY INHIBITING COUNTERCLOCKWISE WHIRL DURING DIRECTIONAL DRILLING

BACKGROUND

Some wells may need to be drilled using a complex trajectory to reach multiple target areas or to perform other operations. Therefore, operators must be able to precisely "steer" the drilling direction. To do this, operators can remotely operate a directional drilling device near the drill bit to control the drilling direction. Various types of directional drilling devices are known in the art. One such device uses a variable stabilizer, such as disclosed in U.S. Pat. No. 4,821,817, to control the drilling trajectory. The variable stabilizer has stabilizer blades that center the drill string within the borehole. Drilling mud pumped downhole is used to control the variable stabilizer by retracting the blades. When selected blades are retracted, the device permits the drilling angle of the drill bit to be changed.

Another directional drilling device is commonly referred to as a bent housing mud motor. This device uses a mud motor disposed on a housing that has an axis displaced from the axis of the drill string. In use, circulated drilling fluid hydraulically operates the mud motor, which has a shaft connected to a rotary drill bit. By rotating the drill bit with the motor and simultaneously rotating the motor and bit with the drill string, the device produces an advancing borehole trajectory that is parallel to the axis of the drill string. However, by rotating the drill bit with the motor but not rotating the drill string, the device can produce a borehole trajectory deviated from the axis of the non-rotating drill string. By alternating these two methodologies, operators can control the path of the borehole.

Another directional drilling device is a rotary steerable system that can change the orientation of the drill bit to alter the drilling trajectory but does not require rotation of the drill string to be stopped. One type of rotary steerable system is disclosed in U.S. Pat. No. 6,116,354, which is incorporated herein by reference. Although effective, rotary steerable systems during certain operations can suffer from vibrations and oscillations that can be extremely damaging and hard to control. These uncontrolled vibrations can especially occur when the rotary steerable system is run below a high torque mud motor with a reasonably high speed (i.e., a total bit RPM of about 110). Generally the higher the RPM, the higher the likelihood of CCW whirl.

In particular, a bottom hole assembly having a rotary steerable system essentially acts as a series of rotating cylindrical spring mass systems with variable support points (typically stabilizers or extended blades). The natural frequencies of these spring mass systems can create a variety of damaging vibrations during operation. Ideally, the bottom hole assembly experiences concentric rotation so that drill bit has sliding contact with the borehole wall. Although the assembly may initially be in sliding contact, the assembly eventually tries to ride up the wall in a horizontal borehole, but gravity and bending strain tend to throw the assembly back downslope.

The riding and dropping of the assembly in the borehole can intensify and becomes more violent with increasing impact loads propelling the assembly back and forth across the borehole. Eventually, the multiple impacts can develop into counterclockwise (CCW) bit whirl in which the drill bit is in continuous rolling contact with the borehole wall. At this stage, the frequency of the whirl action jumps dramatically, and the bottom hole assembly oscillates in a counterclockwise direction opposite to the rotation of the drill string. In general, the resulting motion can be defined by a Hypocycloid sub form of general Hypotrochoids. (This is true for a point on the outer surface of the BHA because the center describes a circle of diameter equal to the borehole clearance). The whirl action from the drill bit can travel up the drill string and can affect multiple points on the assembly.

As expected, counterclockwise bit whirl can unevenly wear the drill bit's cutters and can create fatigue in the various components of the bottom hole assembly and drill string. For this reason, operators need a way to reduce or minimize the development of counterclockwise bit whirl in a bottom hole assembly having a rotary steerable system or any other rotary drilling assembly.

SUMMARY

A bottom hole assembly for directional drilling avoids damaging vibrations that conventional assemblies may experience during operation. The assembly has a drill bit, a first collar that rotates with the drill bit, a rotary steerable tool that can control the trajectory of the drill bit, and a second collar that rotates with the drill string used to deploy the assembly.

The rotary steerable tool can use point-the-bit or push-the-bit technology. For example, the rotary steerable tool can have a center shaft that drives the drill bit and can have a non-rotating sleeve disposed about the center shaft and configured to remain rotationally stationary relative to the shaft. Hydraulically actuated pistons on a mandrel disposed in the sleeve can deflect the center shaft relative to the sleeve to direct the drill bit, and a stabilizer disposed on the first collar can act as a fulcrum point for the tool. During operation, both the drill string and the bit are rotated, and a mud motor on the assembly can impart rotation to the drill bit.

In one arrangement, the first collar coupled between the drill bit and the rotary steerable tool defines a bend that deflects the drill bit from an axis of the first collar. The bend can be predefined in the collar or can be adjustable. During operation, this bend causes a portion of the bottom hole assembly to engage the borehole wall. In this way, the bend can inhibit counterclockwise (CCW) bit whirl from developing at the drill bit by promoting clockwise whirl in a portion of the bottom hole assembly, generating friction against the borehole wall, and dampening vibrations generated at the assembly. By inhibiting or even preventing CCW bit whirl at the bottom hole assembly, other damaging vibrations such as CCW whirl in the drill string can also be prevented from forming up the borehole. In other arrangements, only the second collar between the tool and the drill string can define a bend, or both the first and second collars can define bends.

DETAILED DESCRIPTION

Figure 1:
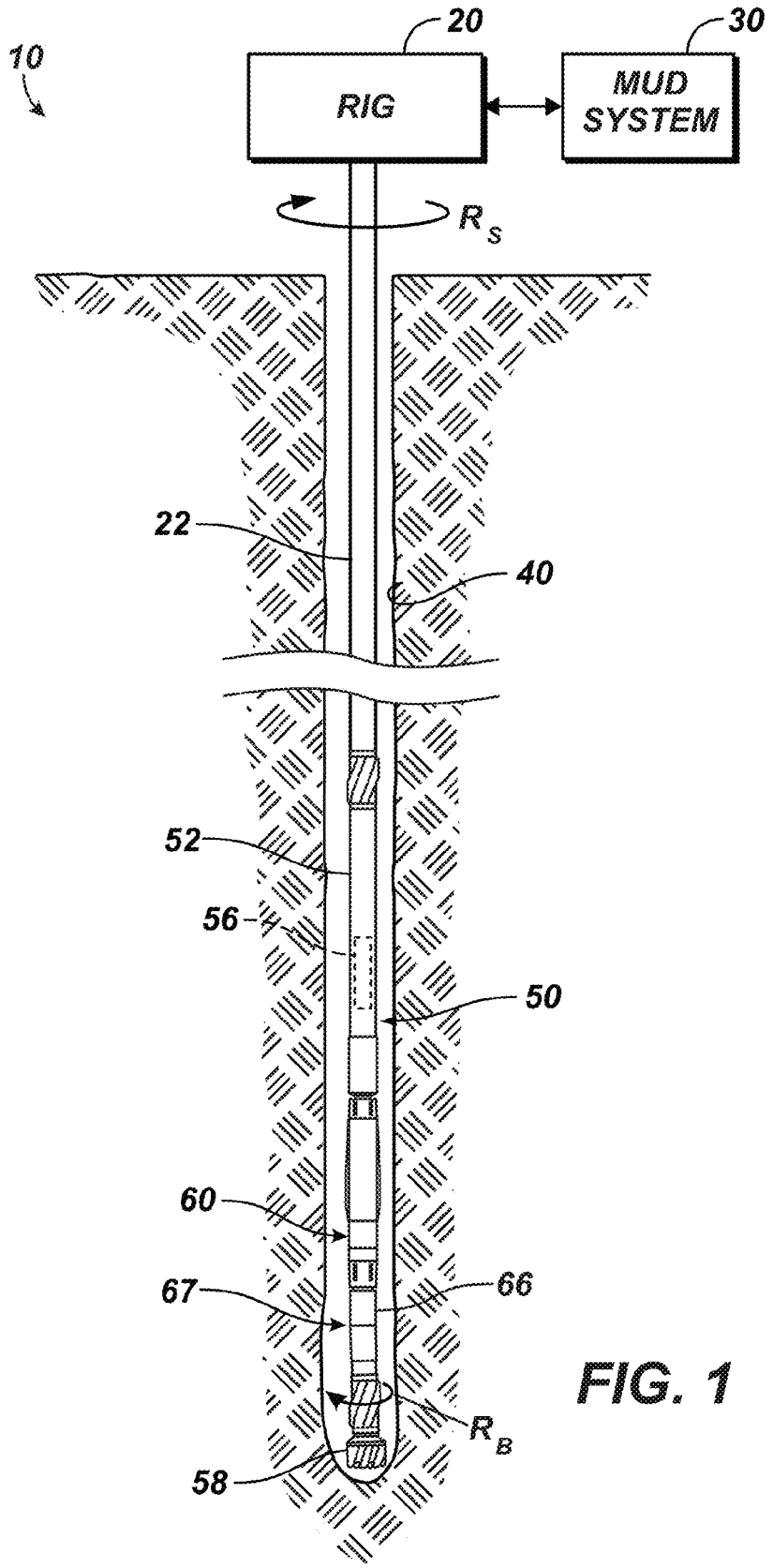
FIG. 1 illustrates a bottom hole assembly having a rotary steerable tool according to the present disclosure.

A directional drilling system 10 in FIG. 1 has a bottom hole assembly 50 deployed on a drill string 22 in a borehole 40. Although shown vertical, this borehole 40 can have any trajectory. The assembly 50 has an upper collar 52, a rotary steerable tool 60, a lower collar 66, and a drill bit 58. In general, the upper collar 52 can house a control electronics insert having batteries, directional sensors (e.g., magnetometers, accelerometers, gamma ray sensors, inclinometers, etc.), a processing unit, memory, and downhole telemetry components. The bottom hole assembly 50 can also have a mud motor 56 positioned in this upper collar 52 or elsewhere so that the mud motor 56 can provide torque to the drill bit 58 via a shaft (not shown) passing through the rotary steerable tool 60.

During operation, a rotary drilling rig 20 at the surface rotates the drill string 22 connected to the bottom hole assembly 50, and a mud system 30 circulates drilling fluid or "mud" through the drill string 22 to the bottom hole assembly 50. The mud operates the mud pump 56, providing torque to the drill bit 58. As the drill string 22 rotates, the drill bit 58 and lower collar 66 also rotate. Eventually, the mud exits through the drill bit 58 and returns to the surface via the annulus.

During drilling, the rotary steerable tool 60 can be operated to direct the drill bit 58 in a desired direction using point-the-bit technology discussed later so that the bottom hole assembly 50 can change the drilling path. As noted previously, however, the bottom hole assembly 50 with the rotary steerable tool 60 can suffer from undesirable vibrations in some circumstances, and the resulting motion from the vibrations can be extremely damaging and hard to control, especially when the rotary steerable tool 60 is run below a high torque mud motor 56 with a reasonably high speed (i.e., a total drill bit RPM of about 110). It is believed that damaging vibrations that begin as counterclockwise (CCW) bit whirl starting at the bottom hole assembly 50 and that can travel up the assembly 50 and drill string 22. The frequencies involved in CCW bit whirl can be at least an order of magnitude higher than the drill string's RPM and can be a function of the borehole's diameter, the drill bit's diameter, and dimensions of other components of the bottom hole assembly 50 that act as the driving surfaces for whirl.

Regardless of the frequencies involved, the whirl once CCW bit whirl develops can migrate up the drill string 22 where it changes frequencies as the casing/drill string traction diameters change. This migrating whirl can eventually lead to CCW whirl in the drill string 22. The frequency of this whirl is believed to be established by the relative diameter of tool joints and the casing's internal diameter and is believed to be driven by the bottom hole assembly's CCW bit whirl, which can occur at a different frequency.

To alleviate the problems associated with CCW whirl, the rotary steerable tool 60 has a bend 67 in its rotating lower collar 66 near the drill bit 58. As the collar 66 and bit 58 rotate, the bend 67 in the collar 66 can prevent CCW bit whirl from developing and evolving into other uncontrolled motions, such as whirl in the drill string 22 uphole. The bend 67 can prevent this evolution by clamping portions of the bottom hole assembly 50 in the borehole 40, creating friction between the assembly 50 and the borehole wall, creating clockwise (CW) whirl in the assembly 50, or producing a combination of these actions.

During operation, for example, the rotating bend 67 produces frictional damping as the bent collar 66 is forced straight in the borehole 40. This friction inhibits the drill bit 58 from moving into rolling contact with the borehole wall, which could lead to CCW bit whirl. In addition, the bend 67 preloads the assembly 50 against the borehole wall and dampens harmful vibrations that may develop during operation and attempt to travel uphole. When this bend 67 is forced straight in the borehole 40, for example, the bend 67 clamps portions of the bottom hole assembly 50 and adjacent drill string 22 against the borehole 40. This clamping prevents resonant frequencies from developing and makes it harder for bit whirl to develop and travel uphole, because the traction of the drill bit 58 around the borehole wall cannot be maintained for an entire 360 degrees.

Finally, by engaging the borehole wall, the bend 67 also tends to create clockwise (CW) whirl that inhibits the extremely damaging hypocycloidal CCW bit whirl from developing. As expected, CCW whirl of the bit 58 cannot coexist with CW whirl in the assembly 50 generated by the collar 66. In this way, any CW whirl created by the collar 66 occurring at the collar's rotational frequency forces the drill bit 58 out of continuous rolling contact with the borehole wall and breaks up any CCW bit whirl that may develop.

Figure 2A:
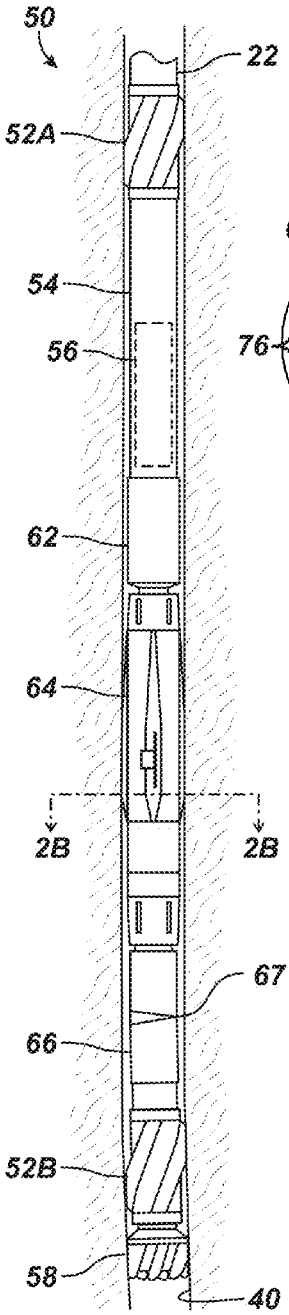
FIG. 2A illustrates the bottom hole assembly with the rotary steerable tool in a first orientation.
Figure 2B:
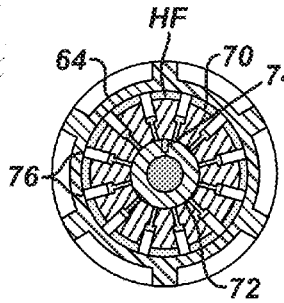
FIG. 2B illustrates an internal cross-section of the rotary steerable tool in FIG. 2A.

As shown in more detail in FIGS. 2A-2B, the bottom hole assembly 50 coupled to the drill string 22 has a drill string stabilizer 52A, the upper collar 54, the rotary steerable tool 60, the lower collar 66, a near-bit stabilizer 52B, and the drill bit 58. The drill string stabilizer 52A provides a contact point to control deflection of the tool 60, and the near-bit stabilizer 52B provides a fulcrum point for deflecting the rotary-steerable tool 60 so that the axis of the drill bit 58 can be oriented to change the drilling trajectory as discussed below.

A suitable system for the rotary steerable tool 60 is the Revolution® Rotary Steerable System available from Weatherford. As shown, the rotary steerable tool 60 has an upper end 62 coupled to the upper collar 54. A center shaft (72; FIG. 2B) extending from components at the upper end 62 passes through the non-rotating sleeve 64 and couples to the lower collar 66, to which the near-bit stabilizer 52B and drill bit 58 couple. Both the non-rotating sleeve 64 and the rotating pivot stabilizer 52B are close to the gage of the borehole 40 to maximize the directional performance of the tool 60. The rotating shaft 72 running through the sleeve 64 transmits torque and weight through the tool 60 to the drill bit 58. However, the non-rotating sleeve 64 is intended to engage the borehole 40 using a number of blades and anti-rotational devices to keep it from rotating.

As shown in the cross-section of FIG. 2B, a mandrel 70 positions within the non-rotating sleeve 64 and has the shaft 72 passing through it. The shaft 72 has a hollow bore for drilling mud to pass through the shaft 72 to the drill bit (58). A plurality of pistons 76 surround the mandrel 70 and engage the inside wall of the sleeve 64. Several banks of these pistons 76 run along the length of the mandrel 70 and shaft 72. These pistons 76 can be operated by high pressure hydraulic fluid HF pumped by a hydraulic system (not shown) driven by the relative rotation between the shaft 72 and the non-rotating sleeve 64.

Figure 3A:
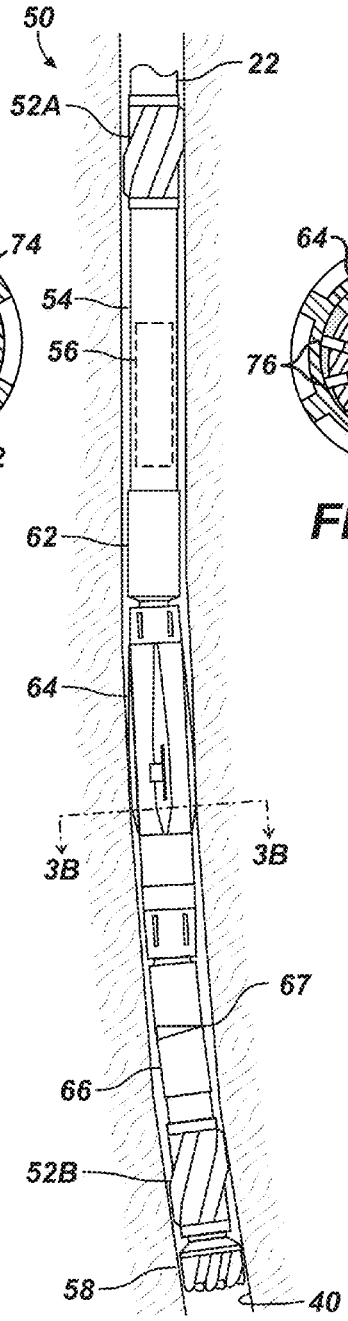
FIG. 3A illustrates the bottom hole assembly with the rotary steerable tool in a second orientation.
Figure 3B:
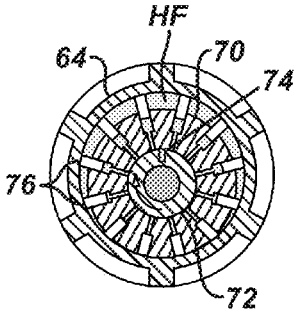
FIG. 3B illustrates an internal cross-section of the rotary steerable tool in FIG. 3A.

As shown in FIGS. 2A-2B, the rotary steerable tool 60 operates in a neutral position to drill a straight section of borehole 40. In this neutral position, the tool's shaft 72 is concentric with the non-rotating sleeve 64 (See FIG. 2B). To control the drilling direction, however, the rotary steerable tool 60 can be deflected as shown in FIGS. 3A-3B. In particular, onboard navigation and control electronics (not shown) monitor the orientation of the tool 60 and its components. When changes in borehole direction are desired, the control electronics activate a solenoid valve (not shown) to pump hydraulic fluid to selected pistons 76 when a commutating valve 74 on the shaft 72 turns relative to the pistons 76. The hydraulic fluid HF pumped to selected pistons 76 causes them to extend outward from the mandrel 70 and to move the mandrel 70 internally relative to the non-rotating sleeve 64. In turn, the moved mandrel 70 deflects the shaft 72 in a direction opposite to the desired trajectory, and the near-bit stabilizer 52B acts as a fulcrum for the shaft 72 to point the drill bit 58 in the desired direction.

Figure 4A:
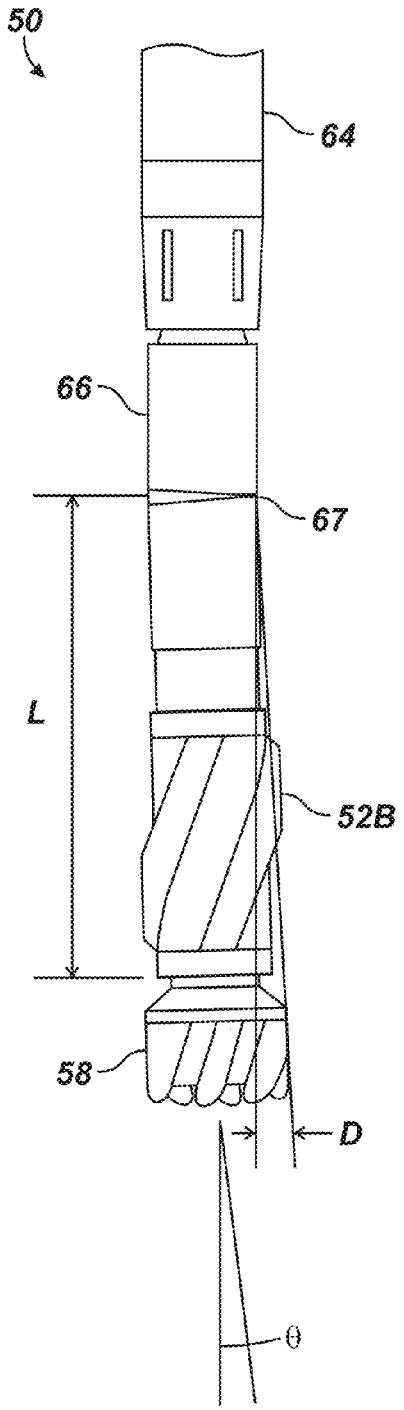
FIG. 4A illustrates an isolated view of the lower end of the bottom hole assembly showing the bend in the lower collar.
Figure 4B:
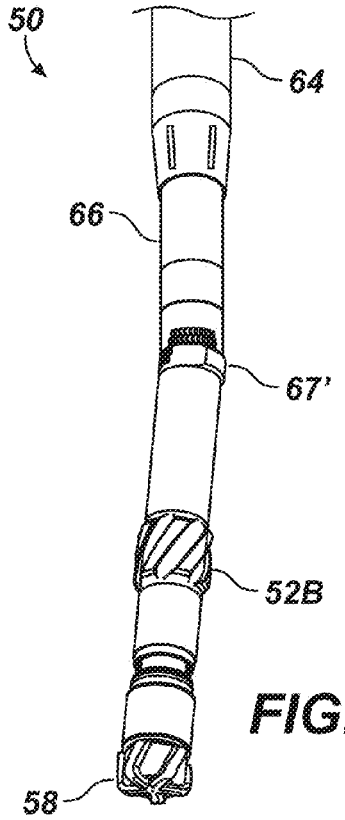
FIG. 4B illustrates an isolated view of the lower end of the bottom hole assembly showing an adjustable bend in the lower collar.

As shown in FIGS. 2A and 3A, the bend 67 in the lower collar 66 essentially loads portions of the bottom hole assembly 50 against the borehole wall, clamping portions of the assembly 50 to the borehole 40, and promoting rotational friction and CW whirl to prevent or reduce the occurrence of CCW whirl and other vibrations as discussed herein. Details of the bend 67 in the lower collar 66 are illustrated in FIG. 4A. The bend 67 can be predefined in an integral collar 66 as shown in FIG. 4A or can be produced between joints of modular components of the collar 66 connected together. Alternatively, an adjustable bend 67' as shown in FIG. 4B can be used. This adjustable bend 67' can operate in a way similar to jointed bends found in bent housing mud motors, such as used on Weatherford's PrescisionDrill™ motor. The adjustable bend 67' can be set at a desired angle between 0 to 3-degrees and can use an internal universal joint.

Figure 4C:
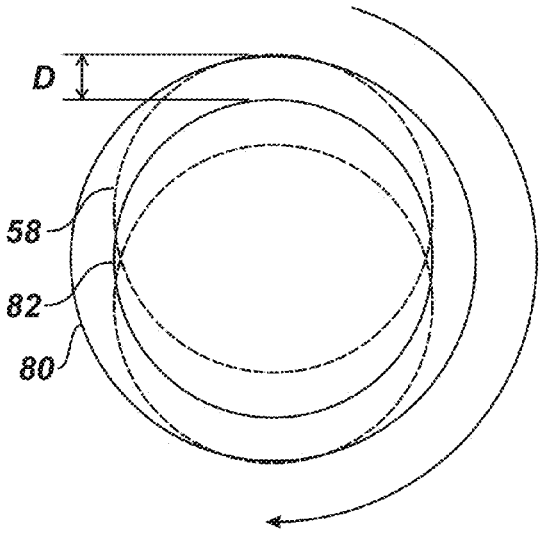
FIG. 4C illustrates the deflection of the drill bit's rotational path produced by the bend in the lower collar.

In one arrangement, the bend 67 may be disposed a length (L) of a several feet or less from the drill bit 58, although the actual distance may vary given a particular implementation, size of the assembly 50, etc. In general, the bend 67 may define an angle (θ) of from 0 to 3-degrees, although the angle may depend on variables of the particular implementation. In addition, the bend 67 may deflect the drill bit 58 by a deflection (D) of about 3/16 inch off axis or more. For example, the deflection (D) of the drill bit 58 may be about ¼-inch from axis of the tool 60, although again the deflection (D) depends on the particular implementation. [Para 33] Given the deflection (D) by the bend 67, the drill bit 58 when rotated sweeps a circular path that drills a borehole slightly larger than the diameter of the drill bit 58. As shown in FIG. 4C, for example, the rotational path of the drill bit 58 deflected by the bend (67) will produce a borehole 80 that has a diameter approximately 2×D (e.g., ½-inch) larger than the borehole 82 that would be produced with a non-deflected drill bit. Operators can take the amount of deflection (D) produced by the bend 67 into account when selecting the size of drill bit 58, stabilizers 52A-B, desired gage of the borehole, etc.

The bend 67 may even tend to dampen string vibration even in over gage holes. For example, the bottom hole assembly 50 having a ¼-inch off axis bend 67 may be effective even in a ⅜-inch over gage borehole. The bend 67 may also dramatically reduce the tendency of the assembly 50 to engage in stick slip oscillation, which are pumped rotational oscillations caused by forcing functions at the drill bit 58. Although the actual amount of deflection required to be effective depends on the stiffness of the bottom hole assembly 50, the deflection load is preferably sufficient to assure that at least a portion of the bottom hole assembly 50 engages and stays in contact with the borehole wall.

Figure 5A:
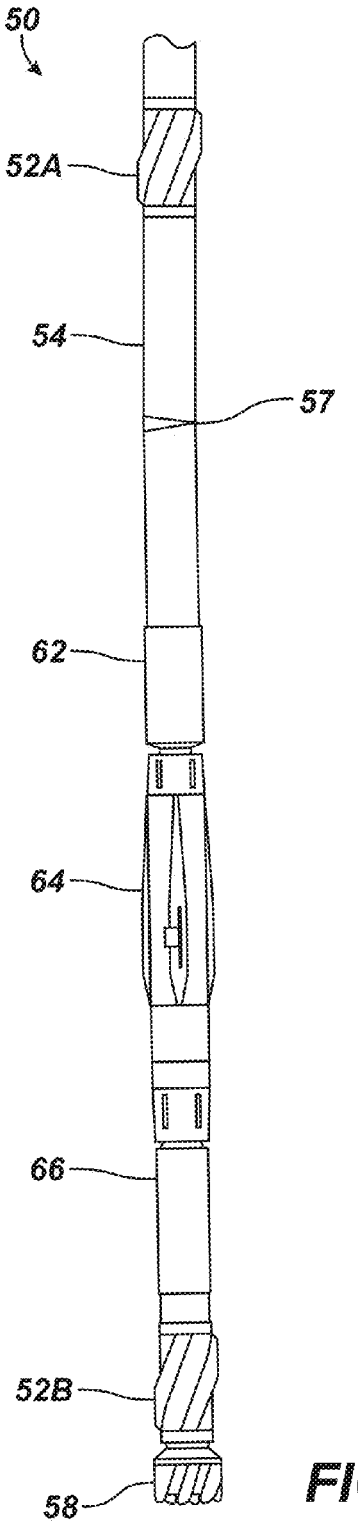
FIG. 5A illustrates a bottom hole assembly having a bend in the collar disposed above the rotary steerable tool.

As discussed above, the lower collar 66 near the near-bit stabilizer 52B can define the bend 67. In an alternative shown in FIG. 5A, the bottom hole assembly 50 can have a bend 57 in the upper collar 54 disposed above the rotary steerable tool 60. As shown, this bend 57 can be positioned between the drill string stabilizer 52A and the rotary steerable tool's sleeve 64. For example, the bend 57 can be applied in the collar 54 or mud motor 56 immediately above the rotary steerable tool 60, although other locations are possible. In one arrangement, the bend 57 can be located a distance of greater than 5-ft. from the bit 58 and can define an angle of about 1 to 1.5 degrees. In this way, the bend 57 can cause the upper section of the rotary steerable tool 60, the mud motor 56, and the assembly's collar 52 immediately above the rotary steerable tool 60 to be loaded against a borehole even in 1-inch over gage boreholes.

Figure 5B:
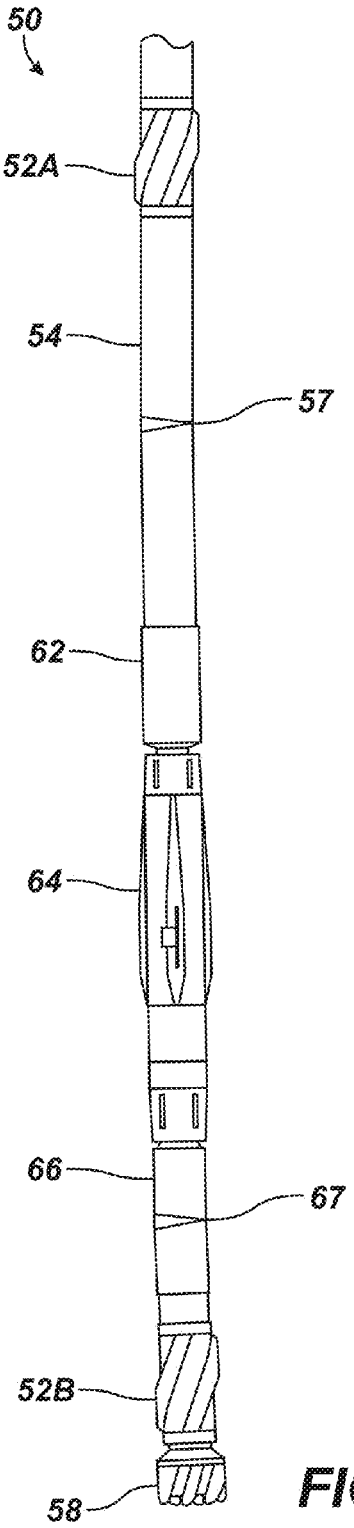
FIG. 5B illustrates a bottom hole assembly having bends in the collars both above and below the rotary steerable tool.

In another alternative shown in FIG. 5B, the bottom hole assembly 50 can have a bend 57 in the upper collar 54 above the rotary steerable tool 60 and can have a bend 67 in the lower collar 66. The upper bend 57 will rotate with the drill string's rotation, while the lower bend 67 will rotate with the drill bit's rotation. This offset in the rotation and contact of these bends 57 and 67 may have benefits in particular implementations.

In this specification, terms such as "upper", "lower" and "bottom" may be used for convenience to denote parts which have such an orientation in the drill string when the drill string extends vertically in a borehole. However, it will be understood that these parts may have a different orientation when the bottom hole assembly is in a section of borehole that deviates from the vertical and may even be horizontal.

Although discussed as being used with the rotary steerable tool 60 that uses point-the-bit technology (namely a center shaft deflected by a mandrel with pistons in a non-rotating sleeve), the teachings of the present disclosure are also applicable to rotary steerable tools that use push-the-bit technology. A push-the-bit rotary steerable tool can use external pads extendable from a non-rotating sleeve to engage the borehole wall to direct the drill bit. Thus, this form of tool can have a center shaft driving the drill bit and can have a sleeve disposed about the center shaft that is configured to remain rotationally stationary relative to the shaft. At least one pad disposed on the sleeve is extendable therefrom to engage the borehole wall to change the trajectory of the drill bit.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A bottom hole assembly having a proximal end and a distal end, the assembly disposed at the proximal end thereof toward a drillstring for directional drilling a borehole with a drill bit disposed toward the distal end thereof, the assembly comprising:

a proximal collar disposed toward the proximal end of the assembly; and a rotary steerable tool extending from the proximal collar and having a distal collar with the drill bit extending therefrom, the rotary steerable tool being operable to change a trajectory of the drill bit, the distal collar rotating in the borehole and having a first bend set at a first set deflection from a first axis of the distal collar, wherein the first bend of the distal collar rotates in the borehole with the distal collar during drilling and causes a portion of the bottom hole assembly to engage the borehole.

2. The assembly of claim 1, wherein the first bend inhibits counterclockwise bit whirl of the drill bit.

3. The assembly of claim 1, wherein the first bend promotes clockwise whirl in a portion of the bottom hole assembly.

4. The assembly of claim 1, wherein the first bend is fixedly configured at the first set deflection on the distal collar.

5. The assembly of claim 1, wherein the first bend is adjustably configured at the first set deflection on the distal collar.

6. The assembly of claim 1, wherein the proximal collar defines a second bend set at a second set deflection from a second axis of the proximal collar, the second bend deflecting the drill bit, the distal collar, and the rotary steerable tool coupled thereto from the second axis of the proximal collar and causing the portion of the bottom hole assembly to engage the borehole.

7. The assembly of claim 6, wherein the second bend inhibits counterclockwise bit whirl of the drill bit or promotes clockwise whirl in a portion of the bottom hole assembly.

8. The assembly of claim 6, wherein the second bend is fixedly or adjustably configured at the first set deflection on the proximal collar.

9. The assembly of claim 6, wherein the proximal collar has a stabilizer disposed thereon and rotatable therewith; and wherein the distal collar has a stabilizer disposed thereon and rotatable therewith.

10. The assembly of claim 6, wherein the proximal collar houses a control electronics insert.

11. The assembly of claim 6, wherein the rotary steerable tool comprises a mechanism pointing or pushing the drill bit to the trajectory.

12. The assembly of claim 6, further comprising a mud motor disposed on the assembly and imparting rotation to the drill bit.

13. The assembly of claim 12, wherein the mud motor is disposed on the assembly uphole of the rotary steerable tool.

14. The assembly of claim 6, wherein the drillstring and the drill bit are rotated simultaneously.

15. The assembly of claim 1, wherein the distal collar has a stabilizer disposed thereon and rotatable therewith.

16. The assembly of claim 1, wherein the proximal collar has a stabilizer disposed thereon and rotatable therewith.

17. The assembly of claim 1, wherein the proximal collar houses a control electronics insert.

18. The assembly of claim 1, wherein the rotary steerable tool comprises a mechanism pointing the drill bit toward the trajectory.

19. The assembly of claim 18, wherein the rotary steerable tool comprises:

a center shaft coupled between the proximal and distal collars;

a sleeve disposed about the center shaft and configured to remain rotationally stationary relative to the shaft; and a mandrel disposed in the sleeve and about the center shaft, the mandrel having a plurality of hydraulic pistons operable to deflect the center shaft relative to the sleeve.

20. The assembly of claim 1, wherein the rotary steerable tool comprises a mechanism pushing the drill bit toward the trajectory.

21. The assembly of claim 20, wherein the rotary steerable tool comprises:

a center shaft coupled between the proximal and distal collars;

a sleeve disposed about the center shaft and configured to remain rotationally stationary relative to the shaft; and at least one pad disposed on the sleeve and being extendable therefrom to engage the borehole wall.

22. The assembly of claim 1, further comprising a mud motor disposed on the assembly and imparting rotation to the drill bit.

23. The assembly of claim 22, wherein the mud motor is disposed on the assembly uphole of the rotary steerable tool.

24. The assembly of claim 1, wherein the drillstring and the drill bit are rotated simultaneously.

25. A method of directional drilling a borehole with a bottom hole assembly having a proximal end disposed toward a drillstring and having a distal end disposed toward a drill bit, the method comprising:

assembling the bottom hole assembly to the drillstring by disposing a proximal collar at the proximal end of the assembly to the drillstring and extending a rotary steerable tool having a distal collar with the drill bit of the assembly from the proximal collar, the distal collar configured to rotate in the borehole;

setting at least one bend in at least the distal collars at a first set deflection from a first axis of the distal collar;

creating the borehole by rotating the drill bit and the distal collar and advancing the bottom hole assembly;

controlling a trajectory of the borehole by operating the rotary steerable tool; and inhibiting counterclockwise bit whirl of the drill bit by causing, with the first set bend rotating in the borehole with the distal collar during drilling, a portion of the bottom hole assembly to engage the borehole.

26. The method of claim 25, wherein setting the at least one bend comprises configuring the distal collar in the bottom hole assembly with a first of the at least one bend fixed or adjusted in the distal collar at the first set deflection from the first axis of the distal collar.

27. The method of claim 26, wherein setting the at least one bend further comprises configuring the proximal collar in the bottom hole assembly with a second of the at least one bend fixed or adjusted in the proximal collar at a second set deflection from a second axis of the proximal collar.

28. The method of claim 25, wherein advancing the bottom hole assembly comprises engaging a stabilizer on the distal collar in the borehole.

29. The method of claim 25, wherein advancing the bottom hole assembly comprises engaging a stabilizer on the proximal collar in the borehole.

30. The method of claim 25, wherein rotating the drill bit and the distal collar comprises rotating the drillstring and the drill bit simultaneously.

31. The method of claim 25, wherein inhibiting counterclockwise bit whirl of the drill bit comprises promoting, with the at least one set bend, clockwise whirl in a portion of the bottom hole assembly.

32. The method of claim 25, wherein operating the rotary steerable tool comprises pointing the drill bit toward the trajectory.

33. The method of claim 25, wherein operating the rotary steerable tool comprises pushing the drill bit toward the trajectory.

34. The method of claim 25, further comprising imparting rotation to the drill bit with a mud motor disposed on the bottom hole assembly.

35. The method of claim 34, wherein imparting the rotation to the drill bit with the mud motor comprises imparting the rotation with the mud motor disposed on the assembly uphole of the rotary steerable tool.

* * * * *